US005350070A

United States Patent [19]

Stamatopoulos et al.

[11] Patent Number: 5,350,070

[45] Date of Patent: Sep. 27, 1994

[54] GUN RACK

[75] Inventors: Michael Stamatopoulos, Broadmeadows; George Silverio, Campbellfield Vic, both of Australia

[73] Assignee: Arma-Lok Pty Ltd., Campbellfield, Australia

[21] Appl. No.: 100,683

[22] Filed: Aug. 2, 1993

[30] Foreign Application Priority Data

Aug. 27, 1992 [AU] Australia ..... PL 4337

[51] Int. Cl.[5] ..... A47F 7/00

[52] U.S. Cl. ..... 211/64; 70/58; 211/4; 224/913

[58] Field of Search ..... 211/64, 4, 87, 189; 70/58; 224/913, 42.45 R

[56] References Cited

U.S. PATENT DOCUMENTS

| | | | |
|---|---|---|---|
| 3,767,093 | 10/1973 | Pinkerton et al. | 211/64 X |
| 3,857,491 | 12/1974 | Townsend et al. | 211/64 X |
| 4,139,100 | 2/1979 | Reed | 211/64 X |
| 4,624,372 | 11/1986 | Brolin | 211/64 X |
| 4,696,405 | 9/1987 | Waring | 211/64 X |
| 5,282,539 | 2/1974 | Saathoff | 211/64 |

*Primary Examiner*—Robert W. Gibson, Jr.
*Attorney, Agent, or Firm*—Thomas R. Vigil

[57] ABSTRACT

The specification describes a modular gun-rack comprising a stock securing unit 1 and a barrel support unit 26. The stock securing unit comprises one or more modular units 2 and the barrel support unit 26 comprises one or more tubular elements 27. Each modular unit comprises a frame having two vertically oriented tubes 5 and 8 and a cross-bar 11. The frame of the upper most modular unit 4 is completed by a cross member 16. The top of each tube defines a sleeve that is capable of receiving a spigot 14, 15 at the bottom of each tube. The lowermost inner tube 5 is secured to a wall by means of a screw. Access to the screw-hole and head of the screw can be gained through hole 34 in the outer face of tube 5 prior to insertion of cross-bar 11 into hole 34. In use tube 5 is secured to a wall by means of a screw, access to which is gained through hole 34. Cross-bar 11 is inserted through the trigger guard of a gun and inserted into hole 34. Cross-member 16 having a spigot 18 at one end and a flange 18 at the other is inserted into the sleeves defined by the tops of tubes 5 and 8 such that flange 18 protrudes from slot 20. Alternatively, further units 3 and 4 can be assembled above unit 2 and the cross-member 16 inserted into the sleeves defined by the tops of tubes 7 and 10. The other end of cross-bar 11 is then inserted into a corresponding hole in the internal face of tube 8 and locked in position by lock 25.

6 Claims, 2 Drawing Sheets

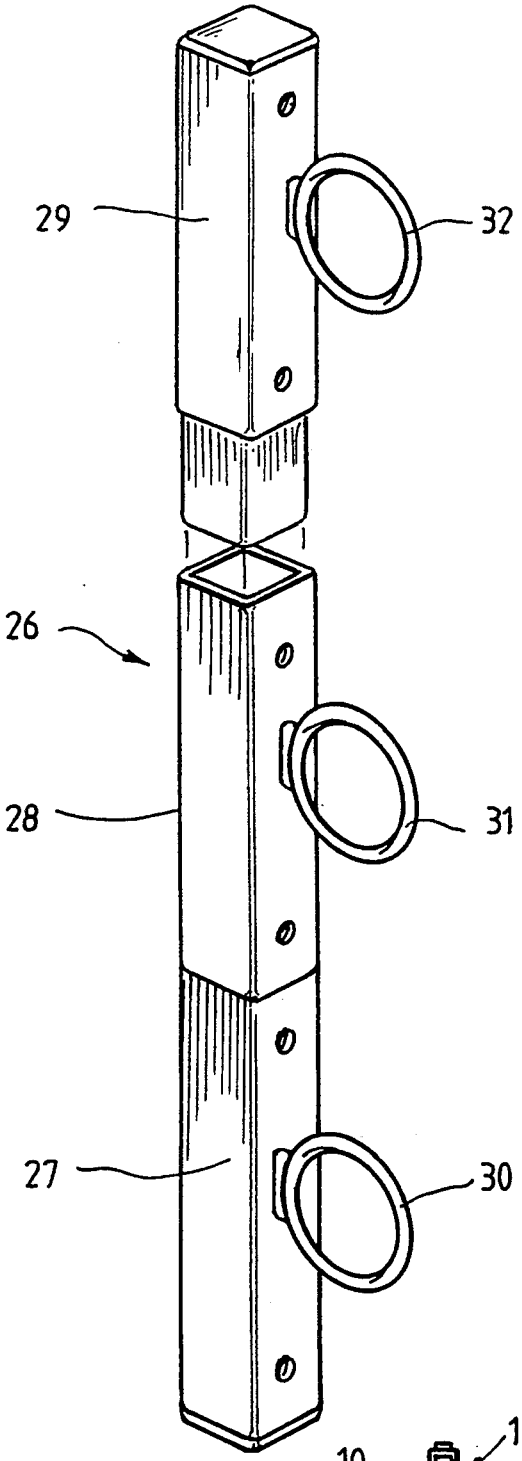
FIG. 2.
FIG. 3.
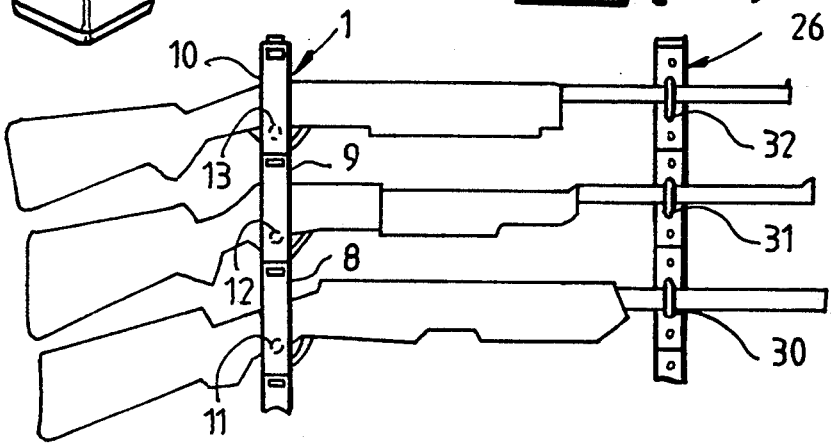

GUN RACK

BACKGROUND OF THE INVENTION

The present invention relates to gun racks.

As gun laws in countries around the world are tightened there is a growing demand for racks that are capable of securing guns to prevent their theft and misuse. However, gun racks currently available in the marketplace are designed for a set member of guns. Thus, if the gun owner has less than the set member the rack is wasteful, or alternatively, if the owner acquires more guns than the spaces available in the rack, a new rack with sufficient space has to be purchased. The capacity of racks currently available on the market cannot be expanded in a modular fashion.

SUMMARY OF THE INVENTION

An object of the present invention is to provide a gun rack that is capable of being expanded in a modular fashion.

Accordingly, the present invention provides a modular gun rack comprising a modular barrel support means and a modular stock support means which when the rack is assembled is suitably spaced from the barrel support means, the modular stock support means comprising a first frame element, a second frame element, a first cross member for joining the first and second frame elements, means for securing the first frame element to a wall, and a second cross member for securing the first frame element to the second frame element, wherein the first cross member is capable of passing through a trigger guard on a gun to secure the gun to the rack when the rack is assembled, and the first and second frame elements have ends that are so adapted that additional frame elements can be attached thereto to extend the rack.

The first and second frame elements may comprise tubes, one end of which has an internal peripheral shape that corresponds with an external peripheral shape of another frame element so that the end of one frame element can be pushed inside the opposed end of another frame element. If the first frame element is tubular it may have a hole in a side thereof which performs the dual role of providing access to a screw hole in an opposite side of the tubular frame element so that the frame element can be secured to a wall and subsequently receive an end of the first cross member. The other end of the first cross member can then be secured by locking means to the second frame element. The first cross member may comprise a rod having a groove in one end, the groove being capable of receiving the tongue of a locking device located within the second frame element to thereby lock the first cross member to the second frame element.

BRIEF DESCRIPTION OF THE DRAWINGS

An embodiment of the invention will now be described with reference to the accompanying drawings in which FIG. 2 is a partially exploded perspective view of a barrel support and FIG. 3 is a front elevation of a rack.

DETAILED DESCRIPTION OF THE INVENTION

Figure 1:
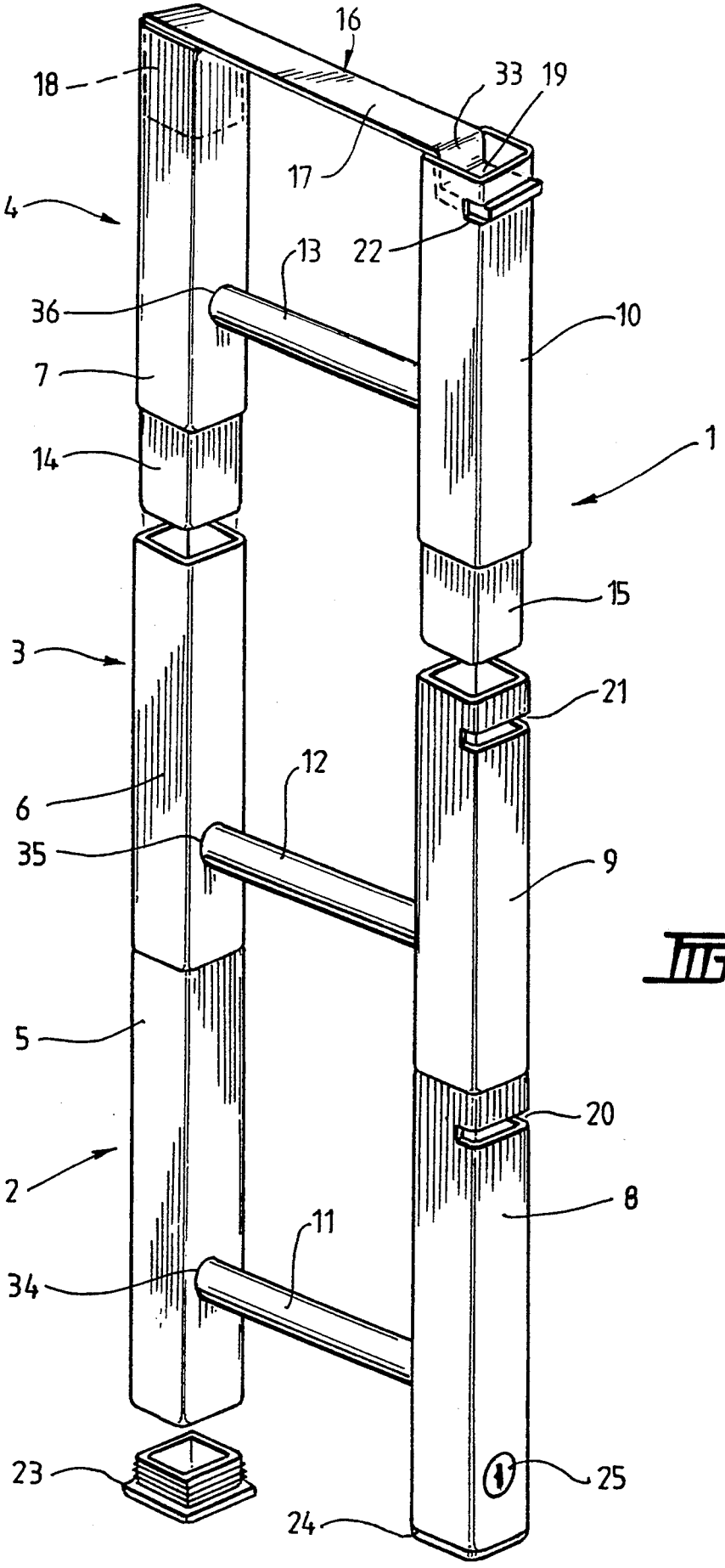
FIG. 1 is a partially exploded perspective view of an assembled modular gun rack according to the present invention.

FIG. 1 illustrates a stock securing unit 1, comprising three modular units 2, 3 and 4. Each modular unit comprises first tubular frame elements 5, 6 and 7, respectively, and second tubular frame elements 8, 9 and 10, respectively- Each modular unit has a first cross member comprising rods 11, 12 and 13, respectively.

The partially exploded view of modular unit 4 in FIG. 1 illustrates that tubular frame elements 7 and 10 have lower ends 14 and 15 of narrower cross section than the external cross section of the respective tops of tubular frame elements 6 and 9, such that ends 14 and 15 may slip inside sleeves defined by tubular frame elements 6 and 9. The unit 1 is also provided with a second cross member 16. Second cross member 16 comprises a rectangular plate 17 having a lug 18 welded to a face at one end thereof. At the opposite end, the plate 17 has been bent to form a flange 19. The bend 33 in the plate 17 is at a point in the plate which enables the flange 19 to fit inside the tubular frame element 10 when the lug 18, is fitted inside the tubular frame element 7. Each of the tubular frame elements 8, 9 and 10 is provided with slots 20, 21 and 22. The slots 20, 21 and 22 are designed to receive the end of the flange 19 when it is inserted inside elements 8, 9 or 10. Tubular frame elements 5, 6 and 7 are provided in one face thereof with holes 34, 35 and 36 respectively that are capable of receiving rods 11, 12 and 13. Faces of tubular frame elements 5, 6 and 7 opposite to the holes 34, 35 and 36 that receive rods 11, 12 and 13 are provided with screw holes (not shown). Access to the screw holes can be gained through the holes 34, 35 and 36 that receive rods 11, 12 and 13.

The base of tubular frame elements 5 and 8 are provided with plugs 23 and 24, respectively. Tubular frame element 8 is also provided with a locking mechanism having a key hole 25 in one face thereof. The locking mechanism has a tongue (not shown) that is capable of being received inside a slot (not shown) formed in one end of rod 11 that is capable of being received into a hole in a face of tubular frame element 8, opposite to key hole 25. Similarly, tubular frame elements 9 and 10 have holes in a face thereof that are capable of receiving rods 12 and 13, respectively, the holes being in a face opposite to the face having slots 21 and 22.

The gun rack also comprises a modular barrel support member 26. The barrel support member comprises tubular elements 27, 28 and 29. Tubular elements 28 and 29 have tubular protrusions at one end thereof that are capable of being received inside the sleeve formed by the tubular frame elements 27 and 28 respectively. Tubular frame element 27 has a ring 30 fixed thereto that is capable of receiving the barrel of a gun therethrough. Similarly, tubular frame element 28 has ring 31 fixed thereto, and tubular frame element 29 has ring 32 fixed thereto.

In use, tubular frame element 27 of the barrel support 26 is fixed to a wall. Tubular frame element 5 of stock support 1 is fixed to the wall in the spaced apart relationship illustrated in FIG. 3. Tubular frame element 5 is secured to the wall by placing a screw or other suitable means through the screw hole and gaining access to the screw head through the hole that is capable of receiving rod 11. The barrel of a gun is inserted through ring 30. Rod 11 is inserted through the trigger guard of a gun and into the hole in tubular frame element 5. Thus rod 11 protrudes transversely from the wall. The free end of rod 11 is then placed inside a hole in tubular frame element 8.

The end of tubular frame element 6 is inserted inside the sleeve formed by tubular frame element 5 and is secured to the wall by means of a screw, access to which can be gained through the hole that is capable of receiving rod 12. Similarly, tubular frame element 28 is placed inside the sleeve formed by tubular frame element 27. The barrel of a second gun is inserted through ring 31 and the second gun is secured to modular unit 3 in a similar member to the manner in which the first gun was secured to modular unit 2. The third modular unit 4 is assembled in a corresponding manner.

Having assembled a three gun rack, the flange 19 of the cross member 16 is inserted into slot 22 with bend 33 abutting the inside of tubular frame element 10. The lug 18 is then lowered into the sleeve formed by the top end of the tubular frame element 7. The 3 guns are secured in the rack by operation of the locking means provided in tubular frame element 8, such that the tongue of the locking means engages the slot in rod 11.

It will be appreciated that while the tongue of the locking means engages the slot in rod 11 there is insufficient flexibility in the external frame formed by elements 8, 9 and 10 to enable the flange of the cross member 16 to be disengaged from the slot 22. Thus, the frame is held securely together. However, when the tongue of the locking means is disengaged from the slot in the rod 11, tubular frame elements 8, 9 and 10 can be pulled away from rods 11, 12 and 13 to provide sufficient movement in tubular frame element 10 for the flange 19 to be disengaged from the slot 22 and the cross member 16 removed so that tubular frame elements 8, 9 and 10 can be removed from rods 11, 12 and 13 as a unit to provide access to the three guns held by the stock securing unit 1.

It will also be appreciated that a major advantage of the gun rack described is that its capacity can be progressively increased in modules.

What is claimed is:

1. A modular gun rack comprising a modular barrel support means for supporting a barrel of a gun and modular stock support means for supporting a stock of the gun, the stock support means being suitably spaced from the barrel support means when the rack is assembled and installed, the modular stock support means comprising a first frame element, a second frame element, a first cross-member for joining the first and second frame elements, securing means for securing the first frame element to a wall, and a second cross-member for securing the first frame element to the second frame element, wherein the first cross-member is capable of passing through a trigger guard of a gun to secure the gun when the rack is assembled and the first and second frame elements have ends that are so adapted that corresponding additional frame elements can be attached thereto to extend the modular glen rack.

2. A modular gun rack according to claim 1 wherein the first and second frame elements comprise tubes one end of which has an internal peripheral shape that corresponds with an external peripheral shape of another frame element so that the end of the other frame element can be pushed inside said one end.

3. A modular gun rack according to claim 2 wherein the securing means comprises a screw and the first frame element has a hole in a side thereof which performs the dual role of providing access to a screw hole in an opposite side of the first frame element so that the first frame element can be secured to a wall by means of the screw and subsequently receive an end of the first cross-member.

4. A modular gun rack according to claim 3 wherein the second frame element contains locking means that are capable of locking the first cross-member to the second frame element.

5. A modular gun rack according to claim 4, wherein the first cross-member comprises a rod having a circumferential groove at one end thereof that is capable of receiving a tongue of the locking means.

6. A modular gun rack according to claim 2, wherein the second cross-member is a flat metal strip having a lug at one end and a stepped flange at an opposed end thereof, the lug being capable of insertion into said one end of the first frame element and the stepped flange being capable of insertion into said one end of the second frame element so that one end of the flange protrudes from a slot in a side of said one end of the second frame element and the shaped end of the flange abuts an opposed side of said one end of the second frame element.

* * * * *

UNITED STATES PATENT AND TRADEMARK OFFICE

CERTIFICATE OF CORRECTION

PATENT NO. : 5,350,070

DATED : September 27, 1994

INVENTOR(S) : Michael Stamatopoulos and George Silverio

It is certified that error appears in the above-indentified patent and that said Letters Patent is hereby corrected as shown below:

Column 1, line 12, "member" should be --number--.

Column 4, line 12, "glen" should be --gun--.

Signed and Sealed this

Thirteenth Day of December, 1994

*Attest:*

*Attesting Officer*

BRUCE LEHMAN

*Commissioner of Patents and Trademarks*